US007082622B1

(12) United States Patent
Olander

(10) Patent No.: US 7,082,622 B1
(45) Date of Patent: Aug. 1, 2006

(54) BELT AND BELT BUCKLE CONSTRUCTION

(76) Inventor: John N. Olander, 1280-1 Glennerye, Laguna Beach, CA (US) 92651

( * ) Notice: Subject to any disclaimer, the term of this patent is extended or adjusted under 35 U.S.C. 154(b) by 304 days.

(21) Appl. No.: 10/784,405

(22) Filed: Feb. 23, 2004

(51) Int. Cl.
*A41F 1/00* (2006.01)

(52) U.S. Cl. ..... 2/336; 24/163 R

(58) Field of Classification Search ..... 2/338, 2/310–325, 334, 336; 24/163 R, 170, 178, 24/188, 180, 163 K
See application file for complete search history.

(56) References Cited

U.S. PATENT DOCUMENTS

| | | | | | |
|---|---|---|---|---|---|
| 1,383,968 | A | * | 7/1921 | Perry et al. | 224/163 |
| 2,855,650 | A | | 10/1958 | Cohen | |
| 4,053,966 | A | * | 10/1977 | Dieleman | 24/163 R |
| 4,100,655 | A | | 7/1978 | Langley | |
| 4,466,561 | A | | 8/1984 | Slaughter | |
| 4,477,949 | A | | 10/1984 | Calabro | |
| 4,521,939 | A | | 6/1985 | Chabot et al. | |
| 4,529,111 | A | | 7/1985 | Hayakawa | |
| 4,570,308 | A | | 2/1986 | Weisgerber | |
| 5,102,023 | A | * | 4/1992 | Nguyen | 224/163 |
| 5,106,004 | A | * | 4/1992 | Nguyen | 224/163 |
| 5,217,150 | A | | 6/1993 | Chen | |
| 5,410,780 | A | | 5/1995 | Silagy | |
| 5,456,462 | A | * | 10/1995 | Wilson | 473/502 |
| 5,609,280 | A | | 3/1997 | Smith | |
| 5,687,890 | A | | 11/1997 | Wanner | |
| 6,597,281 | B1 | | 7/2003 | Thomas | |

* cited by examiner

*Primary Examiner*—Tejash Patel
(74) *Attorney, Agent, or Firm*—James O'Neill; Klein, O'Neill & Singh, LLP

(57) ABSTRACT

A belt buckle has a main body of any desired shape with a rear surface having a belt holding loop and a tang and a front surface with a spinning element rotatably held on a pin in a recess formed in the main body. The main body has indicia held on a surface whereby when the spinning element is spun it will stop and point to one of the indicia. A coordinated belt may be attached to the rear surface of the main body and may have a number of openings formed in rows along its length to allow one or more pegs to be selectively moved along the belt to indicate the results of a game played by spinning the spinning element in the belt buckle.

20 Claims, 2 Drawing Sheets

BELT AND BELT BUCKLE CONSTRUCTION

BACKGROUND OF THE INVENTION

1. Field of the Invention

This invention generally relates to belts and belt buckles, and more particularly, to an improved belt buckle and a combination belt and belt buckle wherein the belt buckle has at least one spinning element and indicia thereon to enable a user to play a game. The belt may include one or more rows of openings and movable pegs, or the like, to enable users to keep track of their progress during playing of a game.

2. Description of the Prior Art

Belts are specifically designed for fastening around the waist of an individual and they generally include a fastening device, such as a belt buckle to hold the ends for the belt together. Belt buckles may come in substantially any shape and/or size, may be simple or highly decorative, and may be provided with additional features or functions, depending on the desires of the wearer of the belt buckle.

Applicant, in pending application Ser. No. 10/733,005, filed on Dec. 11, 2003, describes a decorative spinning belt buckle for use with belts. Applicant's prior spinning belt buckle and other known belts and belt buckles include at least a portion to be secured to one end of the belt and a hook or tang to be selectively secured in openings formed at the other end of the belt.

However, none of the known prior art discloses or shows a belt buckle or combination belt and buckle that may be used to play a game by rotating or spinning an element captured in the buckle to selectively point to indicia on the buckle, and which may also utilize indicating devices, such as pegs or pins, moved along openings formed in the belt to show the status of or keep track of one or more user's progress during play of a game.

Therefore, there exists a need in the art for a belt buckle with which a game may be played. The belt buckle may include at least one rotating or spinning element that points to selected indicia formed on the buckle and which buckle may also be attached to a belt having openings formed therein to capture indicating devices that show the status of a game or that track the results of spinning the element and/or comparing the results of one or more players utilizing the belt buckle to play a game.

The present invention provides a simple, inexpensive and elegant belt buckle and combinations of belts and belt buckles that may be worn by a user and/or utilized to play a game by means of the rotation of a spinning element and indicia on the belt buckle.

SUMMARY OF THE INVENTION

Accordingly, it is a general object of the present invention to provide an improved belt buckle. It is a particular object of the present invention to provide an improved combination belt and belt buckle. It is another particular object of the present invention to provide an improved belt buckle having a main body with a first face comprising a spinning element and indicia formed thereon. It is a still more particular object of the present invention to provide an improved combination belt and belt buckle in which the belt buckle has a main body with a front surface and a rear surface, with indicia and at least one spinning element held in the front surface, and which spinning element may be rotated to selectively point to the indicia. It is a further particular object of the present invention to provide an improved combination belt and belt buckle for playing a game in which the belt buckle has a main body of any desired shape with a pointing element movably held in the main body for rotation to indicated indicia formed on the buckle and wherein the belt has a plurality of openings formed therein whereby pegs or pins may be moved to indicate the status of a game or the progress of one or more players playing a game.

In accordance with one aspect of the present invention, there is provided a belt buckle having a main body with a front surface and a rear surface. At least one element is rotatably secured to the front surface and a belt holding portion and a tang secured to the rear surface. The front face also includes a recessed portion and selected indicia attached thereto or formed thereon, whereby when the element is rotated or spun it will normally stop so as to point at one of the selected indicia. A coordinated or matching belt may be attached to the belt buckle and comprise one or more rows of openings formed therein, whereby pegs or pins may be moved by players in one of the rows of openings along the length of the belt to indicate or compare results.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved belt buckle that may be used alone or in combination with a coordinated or matching belt for enjoyment and/or the playing of a game by one or more persons.

The present invention applies to belt buckles for securing to belts, which belt buckles include a rotating or spinning element that is spun to point to indicia attached to or formed on the belt buckle. After the rotating element is spun and stops at or near one of the indicia the person spinning the same follows instructions contained therein or, if the belt buckle is attached to a coordinated or matched belt, may move a device or piece, such as peg or pin, along a row of openings formed on the belt.

Figure 1:
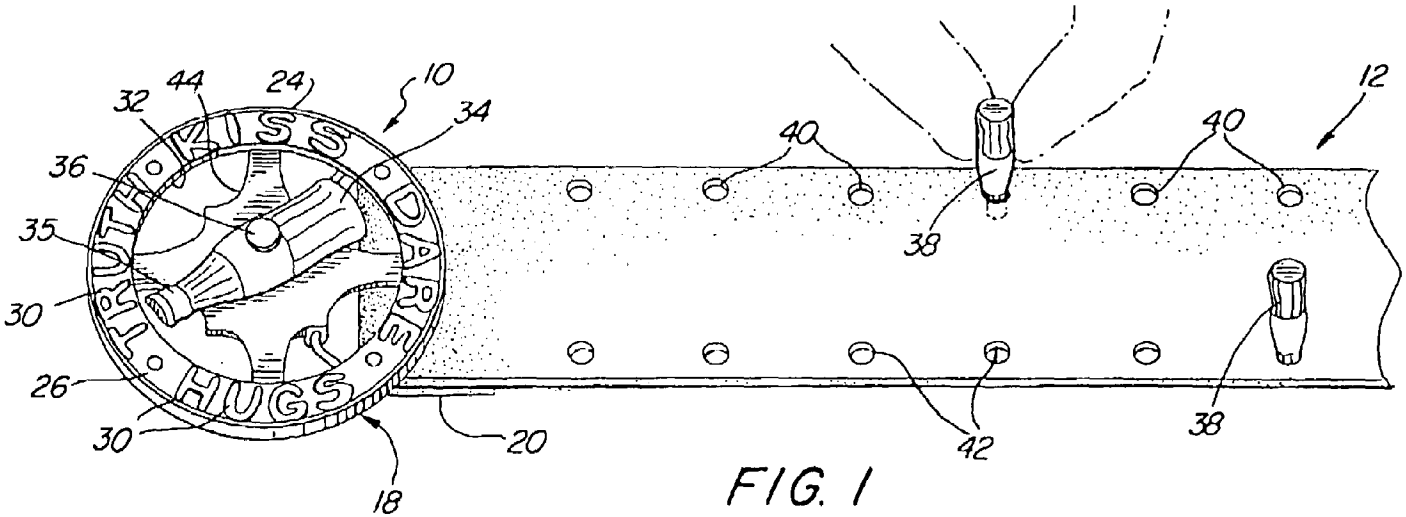
FIG. 1 is a top plan view of a first embodiment of a combination belt and belt buckle of the present invention.
Figure 3:
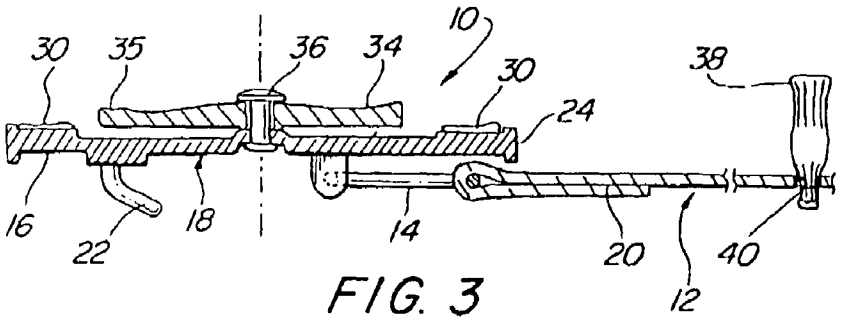
FIG. 3 is a partial cross-sectional view of the belt and belt buckle of FIG. 1.
Figure 2:
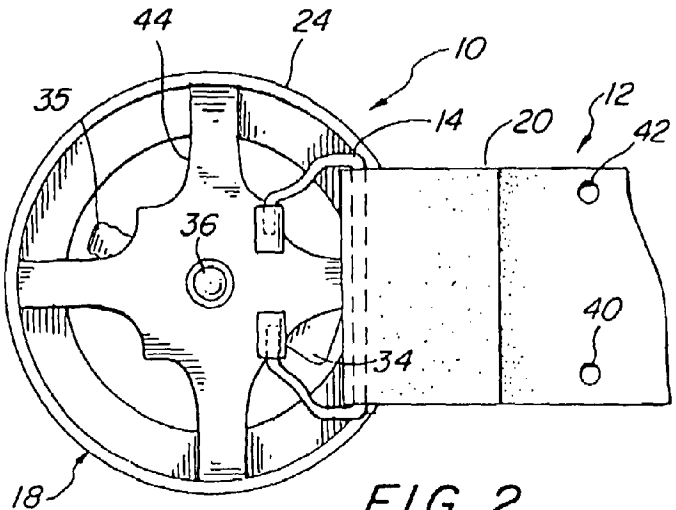
FIG. 2 is a partial rear elevational view of the belt and belt buckle of FIG. 1.

A first embodiment of the belt buckle of the present invention is shown at 10 in FIGS. 1–3. Although this belt buckle 10 may be used alone, it is preferably attached to a coordinated or matched belt 12 by any known means. A currently preferred method of attaching the belt 12 to the buckle 10 uses a holding portion or loop 14 rotatably secured to a rear surface 16 of a main body 18 of the buckle held to a first end 20 of the belt, as by means of a loop of belt material passing through the loop 14 and being folded back and secured to the belt, in any desired manner, as by a snap or stitching. The rear surface 16 also has permanently affixed thereon a hook or tang 22 (see FIG. 3) for cooperation with one or more regularly spaced apertures or holes centrally formed at a second end (not shown) of the belt 12, in a manner well known to those skilled in the art.

The main body 18 includes an outer peripheral edge 24 and a front face or surface 26 having a cavity or recess 28 formed therein and indicia 30 attached to or formed on the front face 26, between the outer peripheral edge 24 and an outer edge 32 of the cavity or recess 28. A spinning element 34, which may take any desired shape, such as a bottle shown in FIGS. 1–3 having an indicating or pointing end 35, is rotatably held in the cavity or recess 28, as by means of central pin or hub 36 having inner and outer ends that are bent or otherwise folded over to rotatably capture the spinning element on the pin in the cavity. The element 34 may, therefore, be easily rotated in the cavity until it stops with the indicating or pointing end 35 pointing at one of the indicia 30 to indicate an action that could or should be taken by the person spinning the element.

The indicia 30 may take any desired form, such as designs, words, numbers, or the like, to allow a game to be played when the element 34 is spun. For example, the indicia 30 may be words, such as "DARE", "HUGS", "KISS" or "TRUTH", to allow a game, such as spin the bottle to be played. Or, the indicia may be designs, numbers or letters to allow the person spinning the element 34 to play a game such as roulette, or to spell out a word or words, or to move an indicating device, such as a peg or pin 38 along one or more rows of spaced apertures or openings 40, 42 formed along the center or sides of the belt 12. Two or more persons can rotate the spinning element 34 and then move their respective pins 38 along one of the rows of apertures or openings 40, 42 to compare their results. The apertures or openings 40, 42 may pass all the way through the belt 12, as shown in FIG. 3, or may bottom out therein, depending on the thickness of the material forming the belt, and provided that the pegs or pins 38 may be retained in the apertures or openings 40, 42 in the belt when the belt is being worn and/or a game is being played. The pegs or pins 38 may be stored in the belt buckle 10 or the belt 12, out of the way, when not in use, in any convenient manner, such as in further openings or apertures formed in the buckle or belt, or a pocket formed in the belt.

As shown in FIGS. 1 and 2, the recessed area 28 in the main body 18 may be provided with one or more open areas 44 passing through the main body to the rear surface 16 for aesthetic purposes, and/or to form a simulated game, such as spin the bottle, roulette, or any other type of game that includes a rotary or spinning element such as 34. Or, the open areas 44 may be provided to lessen the weight of a large metal buckle. Furthermore, the open areas 44 in the cavity or recess 28 also allow the spinning element 34 to be more easily viewed and/or rotated or spun by a user, or by the insertion of a device or other item into the cavity or recess 28.

The main body 18 and remaining portions of the belt buckle 12 are preferably made from a metal for aesthetic purposes, durability and strength. Although it is to be understood that for fashion or other purposes the body 18 and remaining portions of the belt buckle 10 could be made from ceramic, plastic, or the like. The coordinated or matching belt 12 may be made from any desired belting material in any desired color or colors and may include decorative items or stones thereon.

Figure 4:
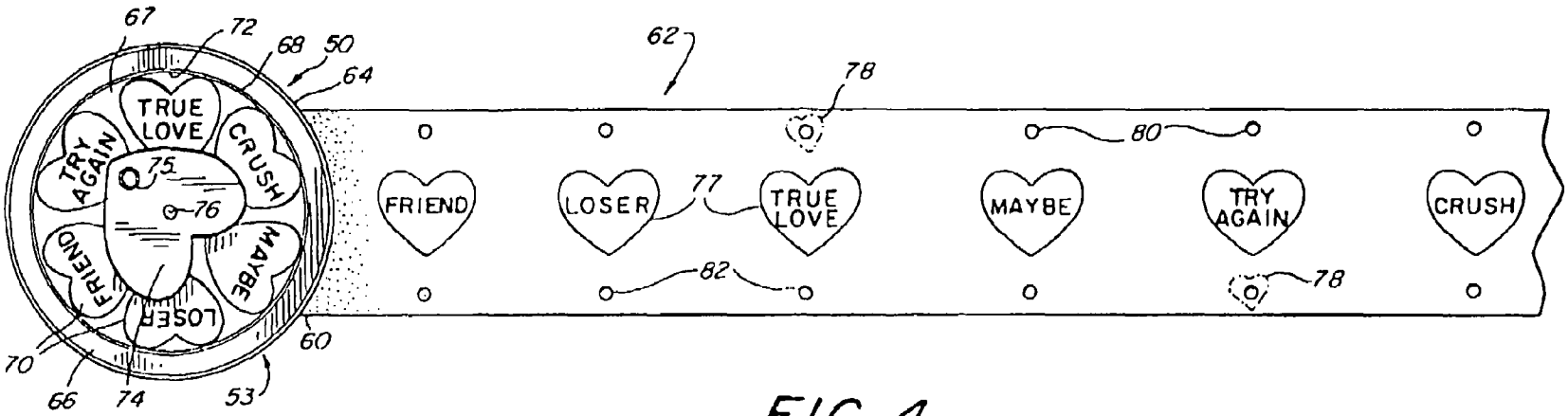
FIG. 4 is a top plan view of a second embodiment of a combination belt and belt buckle of the present invention.

A second embodiment of the spinning belt buckle of the present invention is shown at 50 in FIG. 4. This belt buckle 50 comprises a main body 58 that is preferably held to a first end 60 of a belt 52 by a holding portion or loop, not shown, such as the loop 14, rotatably secured to a rear surface of the main body 58. The rear surface of the main body 58 would also have permanently affixed thereon a hook or tang (not shown), substantially identical to hook or tang 22.

The main body 58 includes an outer peripheral edge 64 and a front surface 66 having a cavity or recess 68 formed therein and indicia 70 attached to or formed thereon, preferably in the cavity or recess on a substantially flat surface 67, between an outer edge 72 of the cavity or recess 68 and a pin or central hub 76. A spinning element 74, which may take any desired shape, such as a heart, or the like, as shown in FIG. 4, is rotatably held in the cavity or recess 68 on the central pin or hub 76. The spinning element 74 preferably has an indicating or pointing portion or area 75 that may include a light or stone. The spinning element 74 is rotated in the cavity until it stops with the indicating or pointing portion 75 pointing at one of the indicia 70 to indicate a result for or an action that could or should be taken by the person spinning the element.

The indicia 70 may also take any desired form as described above, but is preferably words, such as "CRUSH", "FRIEND", "LOSER" or "TRUE LOVE", "TRY AGAN" to allow a game to be played that indicates if a person has found love. Furthermore, the coordinated or matched belt 52 may be marked with the same indicia in hearts or other designs 77, and when the spinning element 74 is spun the person spinning the element can move an indicating device, such as a peg or pin 78, along a rows of apertures or openings 80, 82 formed along the center or sides of the belt 52. Two or more persons can rotate the spinning element 74 and then move their respective pins 78 along one of the rows of apertures or openings 80, 82 to the indicated word, or an indicated number of spaces and compare their results. The apertures or openings 80, 82 may pass all the way through the belt 52, or may bottom out therein, depending on the thickness of the material forming the belt, and provided that the pegs or pins 78 may be retained in the apertures or openings 80, 82 in the belt when the belt is being worn and/or a game is being played. The pegs or pins 78 may also be stored in the belt buckle 50 or the belt 52, as described above.

Figure 5:
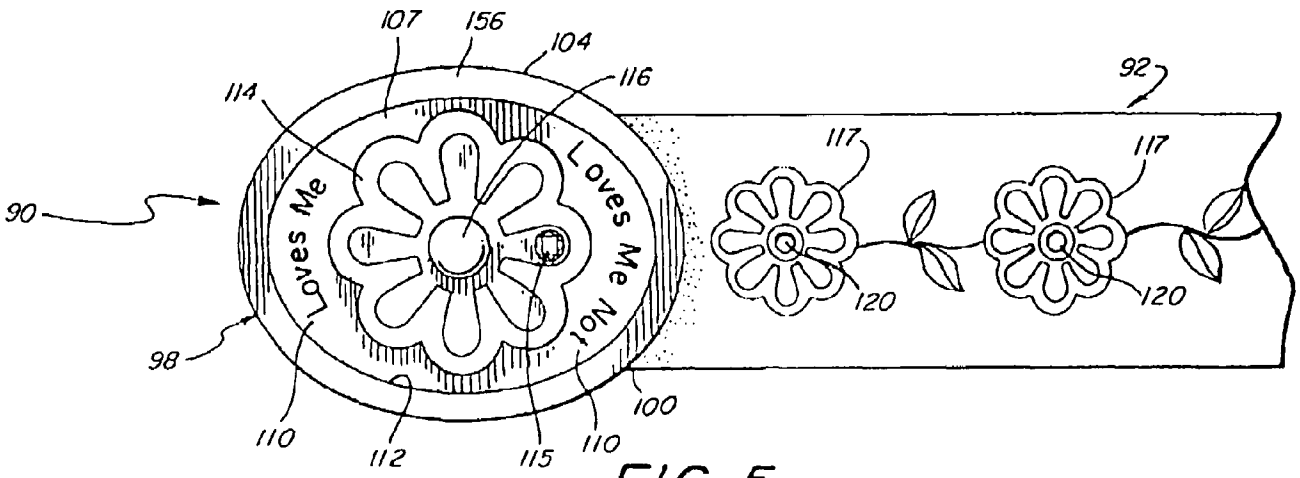
FIG. 5 is a top plan view of a third embodiment of a belt and belt buckle of the present invention.

A third embodiment of the spinning belt buckle of the present invention is shown at 90 in FIG. 5. This belt buckle 90 comprises a main body 98 that may be any desired shape, such as oval, as shown. This belt buckle 90 is preferably held to a first end 100 of a belt 92 by a holding portion or loop not shown, such as the loop 14, rotatably secured to a rear surface of the main body 98. The rear surface of the main body 98 would also have permanently affixed thereon a hook or tang (not shown), substantially identical to hook or tang 22.

The main body 98 includes an outer peripheral edge 104 and a front face or surface 106 having a cavity or recess 108 formed therein and indicia 110 attached to or formed in the cavity or recess on a substantially flat surface 107, between an outer edge 112 of the cavity or recess 98 and a pin or central hub 116. A spinning element 114, which may take any desired shape, such as a substantially circular flower, wheel, or the like, as shown in FIG. 5, has an indicating or pointing portion 115, for example, a light or stone in a petal, spoke, or the like. The spinning element 114 is rotatably held in the cavity or recess 98 on the central pin or hub 116 and may be rotated in the cavity 98 until it stops with the indicating or pointing portion 115 pointing at one of the indicia 110 to indicate an action to take or an answer or result for the person spinning the element.

The indicia 110 may also take any desired form and be any desired as described above, but are preferably at least two set of words, such as "LOVES ME" or "LOVES ME NOT", to allow the person spinning the same to play or determine if a selected person loves them. Although preferably words or phrases, the indicia 110 may also be numbers and the belt 92 maybe marked with substantially circular flowers, wheels, or the like 117 having decorations and/or openings 120 formed centrally in the flowers, wheels, or other designs. Therefore, when the element 116 is spun the person spinning the element can move an indicating device, such as a peg or pin along the openings 120 in the belt 92.

In use, the belt buckles 10, 50, 90 may be used alone or quickly and easily attached to the coordinated, matched or selected belts 12, 52, 92 for use therewith. During use, either alone or while being worn, the spinning elements 34, 74, 114 may be caused to turn or rotate, and a game played therewith by the wearer and/or any other authorized user.

There has thus been described novel and unique belt buckles for use alone or with coordinated or matching belts that includes a rotatable element that when spun points to indicia to enable one or more persons to play a game. The game may include moving selected pieces along one or more rows of openings formed in the belt, thereby providing a pleasing and utilitarian device.

Those skilled in the art will appreciate that various adaptations and modifications of the just-described preferred embodiments may be configured without departing from the scope and spirit of the invention. Therefore, it is to be understood that, within the scope of the appended claims, the invention may be practiced other than is specifically described herein.

What is claimed is:

1. A belt buckle, comprising:

a body having a peripheral side edge, a front surface and a rear surface;

a recess formed on the front surface;

a pin held in the recess in the body;

a belt holding loop and a tang secured to the rear surface;

indicia on the front surface;

a spinning element rotatably mounted in the recess on the pin; and the spinning element including an indicating portion for pointing to the indicia when the spinning element is spun.

2. The belt buckle of claim 1 wherein the indicia is formed on the front surface, between the peripheral side edge and an outer edge of the recess.

3. The belt buckle of claim 1 wherein the indicia is formed on a substantially flat surface in the recess between an outer edge of the recess and the pin.

4. The belt buckle of claim 1, further including at least one aperture formed in the body extending between the front surface and the rear surface.

5. The belt buckle of claim 4 wherein there are a plurality of apertures formed in the body extending between the front surface and the rear surface.

6. The belt buckle of claim 1, further including a coordinated belt attached to the belt buckle.

7. The belt buckle of claim 6 wherein the coordinated belt includes a plurality of spaced openings formed therein.

8. The belt buckle of claim 7 wherein the plurality of spaced openings are formed in a plurality of rows and further including indicating devices for selected movement in the spaced openings along the belt.

9. A combination belt and belt buckle comprising;

a belt buckle body having a peripheral side edge, a front surface and a rear surface;

a recess formed in the front surface;

a pin held in the recess in the belt buckle body;

a belt holding loop and a tang secured to the rear surface of the belt buckle body;

indicia held on the front surface of the belt buckle body;

a spinning element rotatably mounted in the recess on the pin; the spinning element including an indicating portion for pointing to the indicia when the spinning element is spun; and the belt being secured to the belt holding loop on the rear surface of the belt buckle body.

10. The combination belt and belt buckle of claim 9 wherein the belt is coordinated with the belt buckle and the belt has a plurality of spaced openings formed along its length.

11. The combination belt and belt buckle of claim 10 wherein the indicia are formed on the front surface, between the peripheral side edge and an outer edge of the recess.

12. The combination belt and belt buckle of claim 10 wherein the indicia are formed on a substantially flat surface in the recess between an outer edge of the recess and the pin.

13. The combination belt and belt buckle of claim 9 wherein there are a plurality of apertures formed in the body extending between the front surface and the rear surface.

14. The combination belt and belt buckle of claim 9 wherein the belt is coordinated with the belt buckle and includes a plurality of designs and a plurality of rows of spaced openings extending along its length.

15. The combination belt and belt buckle of claim 14 wherein the plurality of rows of spaced openings are adapted to capture and hold indicating devices therein.

16. A combination belt and belt buckle comprising:

a belt buckle body having a peripheral side edge, a front surface and a rear surface;

a recess formed in the front surface;

a pin held in the recess in the belt buckle body;

a belt holding loop and a tang secured to the rear surface of the belt buckle body;

indicia held on the front surface of the belt buckle body;

a spinning element rotatably mounted in the recess on the pin; the spinning element including an indicating portion for pointing to the indicia when the spinning element is spun; and the belt being secured in the belt holding loop and coordinated with the belt buckle; the belt including a plurality of designs and spaced openings formed extending along the belt.

17. The combination belt and belt buckle of claim 16 wherein the indicia are formed on the front surface, between the peripheral side edge and an outer edge of the recess, away from the pin.

18. The combination belt and belt buckle of claim 16 wherein the indicia are formed on a substantially flat surface in the recess between an outer edge of the recess and the pin.

19. The combination belt and belt buckle of claim 16 wherein the plurality of spaced openings are formed in a plurality of rows and the spaced openings are adapted to capture and hold movable indicating devices therein.

20. The combination belt and belt buckle of claim 16 wherein there are a least two separate indicia formed on the front surface of the belt buckle body and there is a single row of spaced openings formed in the belt with designs formed around the spaced openings corresponding to a design formed on the spinning element.

* * * * *